United States Patent [19]

Chauvy

[11] 4,138,811

[45] Feb. 13, 1979

[54] SHAVING FOIL

[75] Inventor: Jean-Daniel Chauvy, Chaumont, Switzerland

[73] Assignee: The Gillette Company, Boston, Mass.

[21] Appl. No.: 829,413

[22] Filed: Aug. 31, 1977

Related U.S. Application Data

[63] Continuation of Ser. No. 699,041, Jun. 23, 1976, abandoned.

[30] Foreign Application Priority Data

Jul. 5, 1975 [GB] United Kingdom ..... 28415/75

[51] Int. Cl.[2] ..... B26B 19/02

[52] U.S. Cl. ..... 30/346.51; 76/104 R

[58] Field of Search ..... 30/346.51; 76/101 SM, 76/104 R

[56] References Cited

U.S. PATENT DOCUMENTS 3,064,349 11/1962 Futterer ..... 30/346.51 X 3,409,984 11/1968 Futterer ..... 30/346.51

FOREIGN PATENT DOCUMENTS 2537607 3/1976 Fed. Rep. of Germany ..... 30/346.51

845832 8/1960 United Kingdom.

*Primary Examiner*—Gary L. Smith

*Attorney, Agent, or Firm*—Richard A. Wise; Donald E. Mahoney

[57] ABSTRACT

This invention concerns a foil for electrically or mechanically operated dry shavers.

More especially the invention concerns a foil made from a sheet having perforations and bars between the perforations, the bars being dished in cross-sectional profile, the base of the dished profile being flat and of uniform thickness (t) while the edges extend at an obtuse angle $\alpha$ to the base, terminating in coplanar faces parallel to the base, the width of the face (w) being not greater than the thickness (t).

The foils are especially suitable for battery operated razors, in which the reduced thickness (t) leads to reduced power consumption and longer battery life.

10 Claims, 4 Drawing Figures

SHAVING FOIL

This is a continuation, of application Ser. No. 699,041, filed June 23, 1976 now abandoned.

FIELD OF THE INVENTION

This invention concerns perforated foils for dry shavers.

STATEMENT OF PRIOR ART

The cutting head of a dry shaver conventionally comprises a perforated stationary outer shear foil and an inner movable cutter contacting the rear face of the shear foil. The cutter can either comprise a plurality of separate blades or it can itself be made from a perforated foil.

Various forms of foil have been proposed in the literature, or employed in practice. For instance, British patent specification No. 845,832 describes a foil whose thickness (from front to rear surfaces) immediately adjacent to the apertures exceeds the thickness of those portions between apertures.

There has, however, been a continued search for new and improved types of foil.

U.S. Pat. No. 3,409,984 to Futterer describes a foil with a thin coating of a hard material on a backing of softer material which is intended to contact the blade of a shaver. The exposed edge of the hard coating provides a hard cutting edge around the rims of the perforations in the foil.

An example of a more recent type of foil is described in German Offenlegungsschrift No. 2,537,607, which describes foils in which the central zone of bars between perforations is surrounded by raised edges (as in the above-mentioned British Pat. No. 845,832), but the metal is thinner in the central zone than it is at the edges. This reduction in thickness is provided to improve the flexibility of the foil. The width of the edges, however, is maintained to ensure a good cutting action.

OBJECT OF THE INVENTION

The object of the present invention is to provide a novel form of perforated foil for a dry shaver.

STATEMENT OF THE INVENTION

According to the present invention there is provided a shearing foil for a dry shaver, made from a sheet of metal or alloy, having perforations extending through the sheet with bars between the perforations, the bars being dished in transverse cross-sectional profile, the base of the dished profile being substantially flat and of uniform thickness (t), and the edges of the dished profile extending at an obtuse angle $\alpha$ to the base to terminate with coplanar faces disposed parallel to the base, said face having a width (w) in the transverse direction which is not greater than the thickness (t).

DESCRIPTION OF DRAWINGS

The invention will be more particularly described with reference to the accompanying drawings, in which.

PARTICULAR DESCRIPTION OF THE INVENTION

Figure 1:
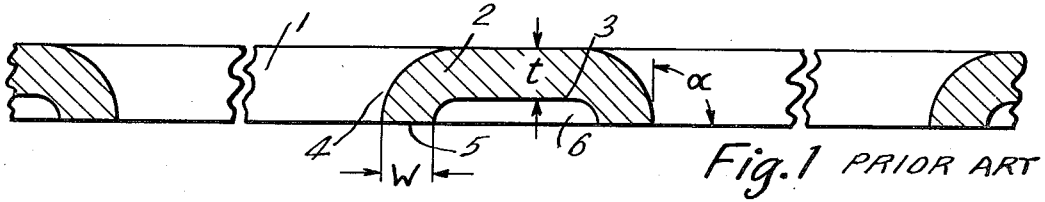
Fig. 1 PRIOR ART
FIG. 1 is a cross-section through a bar on a foil of conventional construction.

Referring now to FIG. 1, a foil has apertures 1 and bars 2 between the apertures. The bars 2 are dished in cross-sectional profile, with a substantially flat base 3 of thickness t and edges 4 extending at an angle $\alpha$ to the base. The edges 4 terminate in faces 5 which are coplanar and parallel to the base 3, and have a width w. The bars therefore, have recessed portions 6.

In accordance with the conventional construction, w is greater than t, and the angle $\alpha$ is substantially a right angle.

Figure 2:
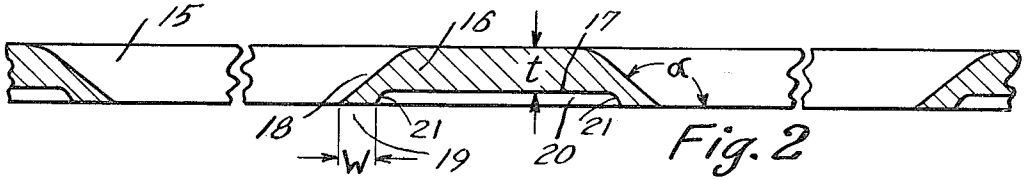
FIG. 2 is a cross-section through a bar on a foil according to the invention.

In accordance with the present invention shown in FIG. 2, $w_1$ is not greater than $t_1$. In other words, $w_1$ can be substantially the same as $t_1$, or it can be less than $t_1$. Preferably $w_1$ is not greater than 0.9 $t_1$, and more preferably not greater than 0.75 $t_1$. The minimum value for $w_1$ is governed by the properties of the metal from which the foil is constructed. Generally $w_1$ will be greater than 0.25 $t_1$. Most preferably $w_1$ is about 0.6 $t_1$.

Also in accordance with the present invention, the angle $\alpha_1$ between the base 17 and the exposed outside edges 18 is an obtuse angle. Conveniently it will lie in the range from 120° to 160°, more preferably from 130° to 150°. The most preferred value for $\alpha$ is around 140°.

The material from which the foils according to the invention are made is a single metal or alloy (e.g. steel), which advantageously and conveniently can be worked by an etching technique. One convenient etching technique for the purpose forms the subject of our copending application No. 699,040. This technique will be described with reference to FIGS. 3 and 4 of the accompanying drawings.

Figure 3:
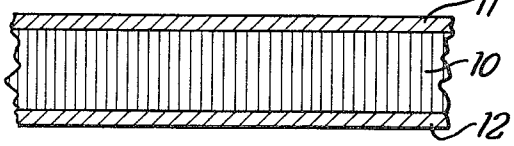
FIGS. 3 and 4 are cross-sections illustrating two stages during a technique by which it is possible to produce a foil according to the invention.
Figure 4:
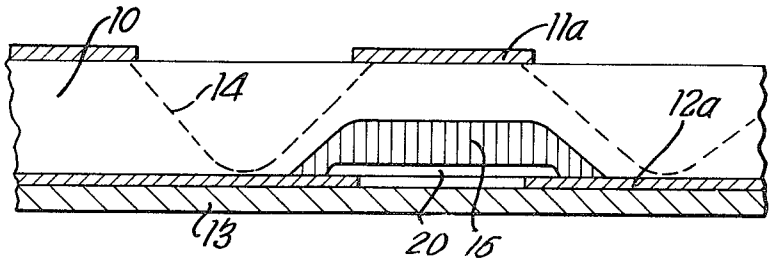

In accordance with this method, a strip 10 of a suitable metal, e.g. laminated steel, is cleaned to remove grease and other contaminants from its surfaces, and is then provided by dip-coating with a layer of a suitable negative or positive photoresist on each surface. A preferred negative photoresist is Waycoat-450 sold by the Philip A. Hunt Chemical Corporation. Another suitable negative photoresist is KMER of Kodak, and a suitable positive photoresist is AZ 111 of Shipley Chemicals Ltd. The layers of photoresist 11 and 12 are hardened by baking. The strip 10 at this stage is shown in FIG. 3. Both layers are then exposed to ultraviolet radiation through appropriate masks, such as exposed and developed photographic film having transparent areas and opaque areas. In the case of a negative photoresist, the mask adjacent the layer 11 will have opaque areas in correspondence to the desired position of the apertures 15, whilst the mask adjacent the layer 12 will have opaque areas in correspondence to the recessed portions $t_1$. Care must of course be taken to ensure that the masks are precisely registered, so that the positions of the apertures 15 and recessed portions 20 in the finished product will be accurate. After the exposure, the photoresist is developed and baked. The strip 10 will have on one side masking areas 11*a* and on the other side, masking areas 12*a* (see FIG. 4).

The face of the workpiece provided with the masking areas 12*a* is then subjected to spray etching, in order to form the recessed portions 20. Once these have been etched to the correct depth, the workpiece is rinsed and dried, and the newly-etched face is protected by a protective film 13, for instance of adhesive tape.

The face of the workpiece provided with masking areas 11*a* is then spray etched, the etching being halted when the metal has been eaten away to position 14, shortly before the apertures are completely formed.

After rinsing, the masking areas 11*a* are removed, leaving the areas 12*a* and protective film 13 in place. Alternatively, both the masking areas 11*a* and 12*a* and the protective film 13 are removed, and a further protective film, for instance a layer of shellac, is applied over the face bearing the recessed portions. Further etching of the unprotected face removes more metal, leaving a foil with apertures 15 and bars 16 having exposed inside edges 21 merging with the base 17 and the exposed outside edges 18 adjacent to the aperture 15. Finally, after an optional chemical polishing step, the protective film is removed, and the finished foil is rinsed and dried.

The foils according to the invention offer several advantages. Clean shaving requires the application of pressure between the outer foil and the movable cutter. The area between these two parts is proportional to $w_1$, so that the smaller the value of $w_1$, the smaller the total force F which must be employed to produce the desired pressure. Since power consumption in use is substantially proportional to F, it must therefore decrease with a decrease in w. A lower power consumption leads to a longer shaving facility between successive charges of the battery in battery-operated shavers.

The following Example illustrates one preferred manner in which a shaving foil according to the invention can be made.

EXAMPLE

A steel strip is subjected to an intensive cleaning involving firstly ultrasonic cleaning in a chlorinated solvent, such as trichloroethylene, or preferably trichloroethane, at room temperature, followed by blow drying. This is followed by alkaline cleaning in a hot degreasing salt solution, with agitation, followed by rinsing with water. A suitable degreasing salt for this purpose is Metex TS40A (from MacDermid) which can be conveniently employed at a temperature of about 40° C. The plate is then subjected to electrolytic cleaning in a cold alkaline cyanide-free solution, e.g. Oxyprep 285 of Oxy Metal Finishing Co., followed by water-rinsing. After neutralizing with dilute 18% hydrochloric acid, washing with water deionized water and isopropyl alcohol, the plate is finally dried in a vapour of a chlorinated solvent, such as trichloroethane.

Both faces of the plate are now provided with a layer of Waycoat 450 photoresist by dip-coating in Waycoat 450 thinned with Waycoat PF thinner to a viscosity providing the required thickness of photoresist. After optional air-drying of the coated plate, the photoresist is provided with a pre-exposure baking, for 10 minutes at 95°–100° C. in a convection oven, or for 2 minutes at 350° C. in an infra-red unit. The photoresist on each side of the plate is then exposed to ultraviolet light through masks made from exposed photographic film having transparent areas and opaque areas. On the side provided with layer 11 (see FIG. 3) the transparent areas will correspond to areas 11*a* (see FIG. 4), and on the side provided with layer 12 the transparent areas will correspond to areas 12*a*. Optimum exposure is achieved by holding 6 to 7 steps after exposure through a Stauffer 21 step sensitivity guide or a Kodak #2 step wedge.

After exposure, development can be carried out by spraying and immersion. It involves contacting the exposed photoresist with Waycoat PF Developer, Waycoat PF Thinner, and water, followed by air drying. The developed photoresist is then baked for 10 minutes at 120° C. in a convection oven or for 2 minutes at 350° C. in an infra-red unit.

Etching is then carried out, advantageously using a double-sided spray-etching apparatus, for instance, the apparatus sold by Chemcut Corporation. Etching can be carried out using Waycoat PF Etchant, but it is advantageous to employ a 48° Beaume solution of ferric chloride, heated to a temperature of 52° C.

The first etching stage is carried out for 20 to 40 seconds to provide the recessed portions 20, followed by rinsing with deionized water and blow-drying with nitrogen. A protective layer of adhesive cellulose acetate tape 13 is then applied. The second etching stage is then carried out to remove metal down to position 14. This involves etching for 100 to 140 seconds, followed by washing with deionized water and blow-drying with nitrogen.

The masking areas 11*a* are then removed using Kodak CP Stripper 13 LS, the recesses 20 and masking areas 12*a* being protected by the protective layer 13. A final etching is carried out using the same etching solution as before, at the same temperature as before. This final etching takes about 40 seconds, followed by washing with deionized water and blow-drying with nitrogen.

A chemical polishing step can then be carried out using a polishing solution suitable for the metal of the strip 10. Suitable solutions are described for instance in Band ½ of "Handbuch der Galvano technik" by Dettner and Elze, Carl Hauser Verlag, Munich.

Finally the protective layer 13 is removed and the remaining masking areas 12*a* are stripped off using Kodak LS 13 stripper. After a final washing with water and blow-drying with nitrogen, the manufacture of the foil is complete.

I claim:

1. A shearing foil for a dry shaver, made from a sheet of single metal, having perforations extending through the sheet with bars between the perforations, the bars being etched to provide the bars with a dished transverse cross-sectional profile having inside and outside edges and a substantially flat recessed base of substantially uniform thickness (t) merging with said inside edges, the dished profile having all of said inside and outside edges and said base being exposed and said exposed outside edges adjacent to the perforations linearly extending at an obtuse angle $\alpha$ to a base to terminate with substantially coplanar faces disposed substantially parallel to the base, said faces having a width (w) in the transverse direction which is not greater than the thickness (t).

2. A shearing foil as claimed in claim 1, wherein w has a value from about 0.25 t to about 0.9 t.

3. A shearing foil as claimed in claim 2, wherein w has a value from about 0.25 t to about 0.75 t.

4. A shearing foil as claimed in claim 2, wherein the obtuse angle $\alpha$ is from about 120° to about 160°.

5. A shearing foil as claimed in claim 4, wherein the obtuse angle $\alpha$ is from about 130° to about 150°.

6. In a shearing foil for a dry shaver, made from a sheet of single metal, having perforations extending through the sheet with bars between the perforations, the bars being dished in transverse cross-sectional profile with inside and outside edges to provide a substantially flat recessed base of uniform thickness (t), the improvement comprising:

the sheet of metal being etched to provide the bars with the dished profile having said base and all of said inside and outside edges exposed, said exposed inside edges merging with said base and all of said exposed outside edges adjacent to the perforations linearly extending at an obtuse angle $\alpha$ to the base to terminate with substantially coplanar faces having a width (w) in the transverse direction which is not greater than the thickness (t).

7. A shearing foil as claimed in claim 6, wherein w has a value from about 0.25 t to about 0.9 t.

8. A shearing foil as claimed in claim 7, wherein w has a value from about 0.25 t to about 0.75 t.

9. A shearing foil as claimed in claim 7, wherein the obtuse angle $\alpha$ is from about 120° to about 160°.

10. A shearing foil as claimed in claim 9, wherein the obtuse angle $\alpha$ is from about 130° to about 150°.

* * * * *